US012630773B2

(12) United States Patent
Tiwari et al.

(10) Patent No.: US 12,630,773 B2
(45) Date of Patent: May 19, 2026

(54) PROCESSES AND APPARATUSES FOR HYDROTREATING A FEED STREAM COMPRISING A BIORENEWABLE FEEDSTOCK WITH ELECTRIC HEATERS

(71) Applicant: UOP LLC, Des Plaines, IL (US)

(72) Inventors: Neeraj Jatashankar Tiwari, Haryana (IN); James T. Wexler, Wheaton, IL (US); Syed Owais Ali, Toronto (CA); Prakhar Agrawal, Haryana (IN)

(73) Assignee: UOP LLC, Des Plaines, IL (US)

( * ) Notice: Subject to any disclaimer, the term of this patent is extended or adjusted under 35 U.S.C. 154(b) by 251 days.

(21) Appl. No.: 18/610,911

(22) Filed: Mar. 20, 2024

(65) Prior Publication Data

US 2025/0136879 A1 May 1, 2025

(30) Foreign Application Priority Data

Oct. 31, 2023 (IN) ..... 202311074080

(51) Int. Cl.
*C10G 69/02* (2006.01)

(52) U.S. Cl.
CPC ..... *C10G 69/02* (2013.01); *C10G 2300/1011* (2013.01); *C10G 2300/4081* (2013.01)

(58) Field of Classification Search
CPC ... C10G 3/00; C10G 3/42; C10G 3/50; C10G 3/60; C10G 45/00; C10G 45/58; C10G 45/64; C10G 65/00; C10G 65/02; C10G 65/04; C10G 65/043; C10G 69/02; C10G 2300/1011; C10G 2300/4081; Y02P 30/20
See application file for complete search history.

(56) References Cited

U.S. PATENT DOCUMENTS

| | | | | |
|---|---|---|---|---|
| 9,580,663 | B2 | 2/2017 | Low et al. | |
| 9,617,484 | B2 * | 4/2017 | Hoehn | C10G 49/24 |
| 10,876,050 | B2 | 12/2020 | Wexler et al. | |
| 11,655,424 | B2 | 5/2023 | Bozzano et al. | |
| 2011/0047862 | A1 | 3/2011 | Mayeur et al. | |
| 2011/0308142 | A1 | 12/2011 | Abhari et al. | |
| 2019/0264114 | A1 * | 8/2019 | Wexler | C10G 65/06 |
| 2023/0159835 | A1 * | 5/2023 | Trivedi | C10G 45/02 585/240 |
| 2023/0250347 | A1 * | 8/2023 | Bozzano | C10G 69/04 208/66 |

OTHER PUBLICATIONS

International Search Report from corresponding PCT application No. PCT/US2024/052992, mailed Feb. 10, 2025.
Written Opinion from corresponding PCT application No. PCT/US2024/052992, mailed Feb. 10, 2025.

* cited by examiner

*Primary Examiner* — Prem C Singh
*Assistant Examiner* — Brandi M Doyle

(57) ABSTRACT

Processes and apparatuses for hydrotreating a feed stream comprising a biorenewable feedstock. The process comprises hydrotreating the feed stream in the presence of hydrogen and a hydrotreating catalyst to provide a hydrotreated stream and isomerizing an isomerization feed stream in the presence of a hydrotreating catalyst to provide an isomerized stream. The isomerization feed stream includes at least a portion of the hydrotreated stream. Electric heaters are provided for one or both recycle vapor streams.

20 Claims, 1 Drawing Sheet

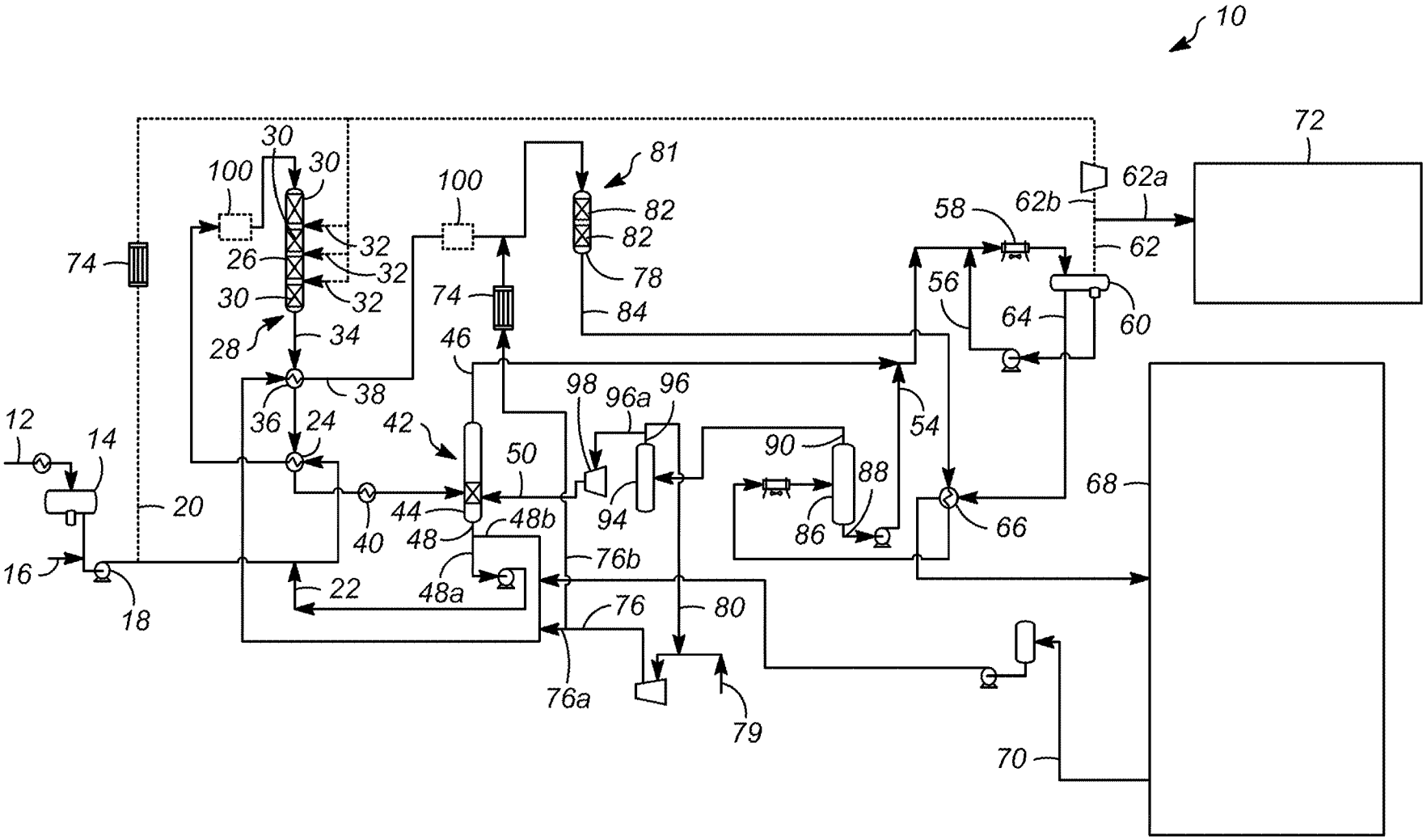
10
72
62a
62
60
62b
64
58
56
54
66
68
70
88
86
90
79
80
81
82
82
78
84
96
96a
94
98
76b
76
76a
50
48b
48a
48
44
42
40
46
74
100
32
32
32
30
30
34
38
24
22
26
30
28
36
100
20
74
18
14
12
16

PROCESSES AND APPARATUSES FOR HYDROTREATING A FEED STREAM COMPRISING A BIORENEWABLE FEEDSTOCK WITH ELECTRIC HEATERS

RELATED APPLICATIONS

This application claims priority to Indian Patent Application No. 202311074080, filed on Oct. 31, 2023, the entirety of which is incorporated herein by reference.

FIELD OF THE INVENTION

This invention relates generally to processes and apparatuses for hydrotreating a feed stream comprising a biorenewable feedstock, and more particularly to such processes and apparatuses which include an electric heater.

BACKGROUND OF THE INVENTION

As the demand for reduced carbon emissions expands, there is an increasing interest in producing fuels and blending components from sources other than crude oil. Often referred to as a biorenewable source, these sources include, but are not limited to, plant oils such as com, rapeseed, canola, soybean, microbial oils such as algal oils, animal fats such as inedible tallow, fish oils and various waste streams such as yellow and brown greases and sewage sludge. A common feature of these sources is that they are composed of glycerides and free fatty acids (FFA). Both triglycerides and the FFAs contain aliphatic carbon chains having from 8 to 24 carbon atoms. The aliphatic carbon chains in triglycerides or FFAs can be fully saturated, or mono, di or poly-unsaturated.

Hydroprocessing can include processes which convert hydrocarbons in the presence of hydroprocessing catalyst and hydrogen to more valuable products. Hydrotreating is a process in which hydrogen is contacted with hydrocarbons in the presence of hydrotreating catalysts which are primarily active for the removal of heteroatoms, such as sulfur, nitrogen, oxygen and metals from the hydrocarbon feedstock. In hydrotreating, hydrocarbons with double and triple bonds such as olefins may be saturated.

The production of hydrocarbon products in the diesel boiling range can be achieved by hydrotreating a biorenewable feedstock. A biorenewable feedstock can be hydroprocessed by hydro treating to remove metals and deoxygenate oxygenated hydrocarbons followed by hydroisomerization to improve cold flow properties of product diesel. Hydroisomerization or hydrodewaxing is a hydroprocessing process that increases the alkyl branching on a hydrocarbon backbone in the presence of hydrogen and hydroisomerization catalyst to improve cold flow properties of the hydrocarbon. Hydroisomerization includes hydrodewaxing herein.

In order for the desired chemical reaction(s) to take place, the feed streams must be heated to a desired or required temperature. In other words, there is a heating requirement for the feed streams. The heating of feed streams is generally done by fired heating. This heating itself generates carbon dioxide from the combustion of hydrocarbon rich fuel gas. In some processes, there may be three or more fired heaters.

Recently, there is an increased focus on using electric heaters instead of fired heaters. While presumably effective for their intended purposes, in the processing of renewable feedstocks, electric heaters are used in vapor phase applications, and therefore, streams that are liquid or two phase (vapor and liquid) may not be able to directly use electric heaters.

Accordingly, it would be desirable to have more effective and efficient ways to hydrotreating a feed stream comprising a biorenewable feedstock with electric heaters providing heat to liquid or two-phase streams.

SUMMARY OF THE INVENTION

The present disclosure provides processes and apparatuses for hydrotreating a biorenewable feedstock which provide electric heaters on recycle vapor streams. The heated vapor streams can effectively and efficiently be heated in an electric heater and then combined with the feed streams to a reaction zone to heat the feed streams before the feed streams are passed into the reactors. In some aspects, both the recycle stream to a hydrotreating reaction zone and a isomerization reaction zone are heated with an electric heater. In some aspects, only one of these recycle streams is heated with an electric heater and a conventional fired heater is used with the other recycle streams. By utilizing at least one electric heater, the carbon dioxide impact can be reduced.

Therefore, the present invention may be characterized, in at least one aspect, as providing a process for hydrotreating a feedstock by: heating a feed stream comprising a biorenewable feedstock to provide a heated feed stream; hydrotreating the heated feed stream in a first reaction zone comprising a first reactor vessel having a hydrotreating catalyst and providing a hydrotreated stream; separating the hydrotreated stream into a hydrotreated liquid stream and a hydrotreated gas stream; heating an isomerization feed stream, wherein the isomerization feed stream comprises at least a portion of the hydrotreated liquid stream; isomerizing the isomerization feed stream in a second reaction zone comprising a second reactor vessel having an isomerization catalyst and providing an isomerized stream; and, separating the isomerized stream into an isomerized liquid stream and an isomerized gas stream; wherein either: both the hydrotreated gas stream and the isomerized gas stream have been separately heated in electric heaters to provide, respectively, a heated hydrotreated gas stream and a heated isomerized gas stream and the feed stream is heated by being combined with the heated hydrotreated gas stream and the isomerization feed stream is heated by being combined with the heated isomerized gas stream; or, only one of the hydrotreated gas stream and the isomerized gas stream has been heated in an electric heater to provide a heated gas stream which heats, by being combined with, one of the feed stream or the isomerization feed stream, and the other of the feed stream or the isomerization feed stream is heated in a fired heater.

Both the hydrotreated gas stream and the isomerized gas stream may have been separately heated in electric heaters to provide, respectively, the heated hydrotreated gas stream and the heated isomerized gas stream and the feed stream may be heated by being combined with the heated hydrotreated gas stream and the isomerization feed stream may be heated by being combined with the heated isomerized gas stream.

Only one of the hydrotreated gas stream and the isomerized gas stream may have been heated in an electric heater which heats, by being combined with, one of the feed stream or the isomerization feed stream, and the other of the feed stream or the isomerization feed stream may be heated in the fired heater.

The hydrotreated gas stream may have been heated in the electric heater to provide the heated hydrotreated gas stream and the feed stream may have been heated by being combined with the heated hydrotreated gas stream. The isomerization feed stream may have been heated in the fired heater.

The isomerized gas stream may have been heated in the electric heater to provide the heated isomerized gas stream and the isomerization feed stream may be heated by being combined with the heated isomerized gas stream. The feed stream may have been heated in the fired heater.

The process may further include compressing the hydrotreated gas stream.

The process may also include compressing the isomerized gas stream.

In another aspect, the present invention may be generally characterized as providing a process for hydrotreating a feedstock by: heating a feed stream comprising a biorenewable feedstock to provide a heated feed stream; passing the heated feed stream to a first reaction zone comprising a first reactor vessel having a hydrotreating catalyst and being operated under conditions to hydrotreat the heated feed stream and provide a hydrotreated stream; passing the hydrotreated stream to a first separation zone configured to separate the hydrotreated stream into a hydrotreated liquid stream and a hydrotreated gas stream; heating an isomerization feed stream to provide a heated isomerization feed stream, wherein the isomerization feed stream comprises at least a portion of the hydrotreated liquid stream; passing the heated isomerization feed stream to a second reaction zone comprising a second reactor vessel having an isomerization catalyst and being operated under conditions to isomerize the heated portion of the hydrotreated liquid stream and provide an isomerized stream; and, passing the isomerized stream to a separation zone configured to separate the isomerized stream into an isomerized liquid stream and an isomerized gas stream; wherein the process further includes: passing the hydrotreated gas stream to a first electric heater to provide a heated hydrotreated gas stream, wherein the feed stream is heated by being combined with the heated hydrotreated gas stream, and passing the isomerized gas stream to a second electric heater to provide a heated isomerized gas stream, wherein the isomerization feed stream is heated by being combined with the heated isomerized gas stream; or, passing the hydrotreated gas stream to a first electric heater to provide a heated hydrotreated gas stream, wherein the feed stream is heated by being combined with the heated hydrotreated gas stream, and wherein the isomerization feed stream is heated in a fired heater to provide the heated isomerization feed stream; or, passing the isomerized gas stream to a second electric heater to provide a heated isomerized gas stream, wherein the isomerization feed stream is heated by being combined with the heated isomerized gas stream, and wherein the feed stream is heated in a fired heater to provide the heated feed stream.

The process may further include passing the hydrotreated gas stream to the first electric heater to provide the heated hydrotreated gas stream, wherein the feed stream is heated by being combined with the heated hydrotreated gas stream, and passing the isomerized gas stream to the second electric heater to provide the heated isomerized gas stream, wherein the isomerization feed stream is heated by being combined with the heated isomerized gas stream. The process may also include compressing the hydrotreated gas stream before passing the hydrotreated gas stream to the first electric heater. The process may include compressing the isomerized gas stream before passing the isomerized gas stream to the second electric heater.

Additionally, the process may include passing the hydrotreated gas stream to a first electric heater to provide a heated hydrotreated gas stream, wherein the feed stream is heated by being combined with the heated hydrotreated gas stream, and wherein the isomerization feed stream is heated in a fired heater to provide the heated portion of the hydrotreated liquid stream. The process may also include compressing the hydrotreated gas stream before passing the hydrotreated gas stream to the first electric heater.

The process may further include passing the isomerized gas stream to a second electric heater to provide a heated isomerized gas stream, wherein the isomerization feed stream is heated by being combined with the heated isomerized gas stream, and wherein the feed stream is heated in a fired heater to provide the heated feed stream. The process may include compressing the isomerized gas stream before passing the isomerized gas stream to the second electric heater.

In still another aspect, the present invention may be characterized, broadly, as providing a process for hydrotreating a feedstock by: hydrotreating a feed stream comprising a biorenewable feedstock in a first reaction zone comprising a first reactor vessel having a hydrotreating catalyst and providing a hydrotreated stream; separating the hydrotreated stream into a hydrotreated liquid stream and a hydrotreated gas stream; heating the hydrotreated gas stream in a first heating zone to provide a heated hydrotreated gas stream; combining the heated hydrotreated gas stream and the feed stream; isomerizing an isomerization feed stream in a second reaction zone comprising a second reactor vessel having an isomerization catalyst and providing an isomerized stream, the isomerization feed stream comprising at least a portion of the hydrotreated liquid stream; separating the isomerized stream into an isomerized liquid stream and an isomerized gas stream; heating the isomerized gas stream in a second heating zone to provide a heated isomerized gas stream; and, combining the heated isomerized gas stream and the hydrotreated liquid stream, wherein both the first and the second heating zones comprise an electric heater.

The process may also include compressing the hydrotreated gas stream in a first compression zone comprising a compressor before heating the hydrotreated gas stream in the first heating zone. The process may further include compressing the isomerized gas stream in a second compression zone comprising a compressor before heating the isomerized gas stream in the second heating zone.

Additional aspects, embodiments, and details of the invention, all of which may be combinable in any manner, are set forth in the following detailed description of the invention.

DETAILED DESCRIPTION OF THE DRAWINGS

One or more exemplary embodiments of the present invention will be described below in conjunction with the following drawing figures, in which:

FIG. 1 shows a process flow diagram according to one or more aspects of the present invention.

DETAILED DESCRIPTION OF THE INVENTION

As mentioned above, apparatuses for hydrotreating a biorenewable feedstock which provide electric heaters on recycle vapor streams have been invented. The electric heaters can replace fired heaters typically used on the liquid and/or two-phase feed streams.

With these general principles in mind, one or more embodiments of the present invention will be described with the understanding that the following description is not intended to be limiting.

In FIG. 1, in accordance with an exemplary embodiment, a process and apparatus 10 is shown for processing a feed stream 12 comprising a feedstock which comprises a biorenewable feedstock.

The term "biorenewable feedstock" is meant to include feedstocks other than those obtained from crude oil. The biorenewable feedstock may include any of those feedstocks which comprise at least one of glycerides and free fatty acids. Most of glycerides will be triglycerides, but monoglycerides and diglycerides may be present and processed as well. Free fatty acids may be obtained from phospholipids which may be a source of phosphorous in the feedstock. Examples of these biorenewable feedstocks include, but are not limited to, camelina oil, canola oil, corn oil, soy oil, rapeseed oil, soybean oil, colza oil, tall oil, sunflower oil, hempseed oil, olive oil, linseed oil, coconut oil, castor oil, peanut oil, palm oil, mustard oil, tallow, yellow and brown greases, lard, train oil, fats in milk, fish oil, algal oil, sewage sludge, and the like. Additional examples of biorenewable feedstocks include nonedible vegetable oils from the group comprising Jatropha curcas (Ratanjot, Wild Castor, Jangli Erandi), Madhuca indica (Mohuwa), Pongamia pinnata (Karanji, Honge), calophyllum inophyllum, moringa oleifera and Azadirachta indica (Neem). The triglycerides and FFAs of the typical vegetable or animal fat contain aliphatic hydrocarbon chains in their structure which have 8 to 30 carbon atoms. As will be appreciated, the biorenewable feedstock may comprise a mixture of one or more of the foregoing examples. The biorenewable feedstock may be pretreated to remove contaminants and filtered to remove solids.

The feed stream 12 may be passed to a feed surge drum 14. From the feed surge drum 14, the feed stream 12 may be mixed with a sulfiding agent 16 and passed to a charge pump 18. Thereafter, the feed stream 12 is mixed with a recycle gaseous stream 20, which contains hydrogen, and a recycle liquid stream 22, and then heated in a heat exchanger 24 before being passed to a reactor vessel 26 in a first reaction zone 28.

Within the reactor vessel 26 of the first reaction zone 28 are one or more catalyst beds 30. For example, a first catalyst bed 30 may be a guard bed which contains a guard bed catalyst for demetallation and deoxygenation, including carbonylation and carboxylation, reactions as well as some denitrogenation and desulfurization reactions. The guard bed catalyst may include a base metal on a support. Base metals useable in this process include nickel, chromium, molybdenum and tungsten. Other base metals that can be used include tin, indium, germanium, lead, cobalt, gallium and zinc. The process can also use a metal sulfide, wherein the metal in the metal sulfide is selected from one or more of the base metals listed. BGB-300 available from UOP LLC in Des Plaines, Ill. may be a suitable catalyst.

A second catalyst bed 30 may contain a hydrotreating catalyst to saturate the olefinic or unsaturated portions of the n-paraffinic chains in the biorenewable feedstock. The hydrotreating catalyst also catalyzes hydrodeoxygenation reactions including decarboxylation and carbonylation reactions to remove oxygenate functional groups from the biorenewable feedstock molecules which are converted to water and carbon oxides. The hydrotreating catalyst also catalyzes desulfurization of organic sulfur and denitrogenation of organic nitrogen in the biorenewable feedstock. Essentially, the hydrotreating reaction removes heteroatoms from the hydrocarbons and saturates olefins in the feed stream. The hydrotreating catalyst may be provided in one, two or more beds 30 and employ interbed hydrogen quench streams 32.

The hydrotreating catalyst may comprise nickel, nickel/molybdenum, or cobalt/molybdenum dispersed on a high surface area support such as alumina. Other catalysts include one or more noble metals dispersed on a high surface area support. Non-limiting examples of noble metals include platinum and/or palladium dispersed on an alumina support such as gamma-alumina. Suitable hydrotreating catalysts include BDO 300 or BDO 400 available from UOP LLC in Des Plaines, Ill. Generally, hydrotreating conditions include a pressure of about 700 kPa (100 psig) to about 21 MPa (3000 psig). The hydrotreating outlet temperature may range between about 343° C. (650° F.) and about 427° C. (800° F.) and preferably between about 349° C. (690° F.) and about 400° C. (800° F.).

A hydrotreated stream 34 is provided by the first reaction zone 28 and has a hydrocarbon fraction which has a substantial n-paraffin concentration. Although this hydrocarbon fraction is useful as a diesel fuel, because it comprises a substantial concentration of n-paraffins from the biorenewable feedstock, it will have poor cold flow properties. The hydrotreated stream 34 can be contacted with an isomerization catalyst under isomerization conditions to at least partially isomerize the n-paraffins to isoparaffins.

Accordingly, the hydrotreated stream 34 may first flow to a combined isomerization feed exchanger 36 to heat an isomerization feed stream 38 (described below) and cool the hydrotreated stream 34. The hydrotreated stream 34 may also be heat exchanged with the feed stream 12 in the first heat exchanger 24 to further cool the hydrotreated stream 34 and heat the feed stream 12. The hydrotreated stream 34 may also be further cooled in a third hear exchanger 40, for example to make steam, before it is passed to a separation zone 42 having a separation vessel 44.

In the separation vessel 44, the hydrotreated stream 34 will be separated to provide a hydrotreated vapor stream 46 and a hydrotreated liquid stream 48 having less oxygen concentration than the biorenewable feed stream 12. The separation vessel 44 may operate at about 177° C. (350° F.) to about 371° C. (700° F.) and preferably operates at about 232° C. (450° F.) to about 315° C. (600° F.). The separation vessel 44 may be operated at a slightly lower pressure than the reactor 26 accounting for pressure drop through intervening equipment. The separation vessel 44 may be operated at pressures between about 3.4 MPa (gauge) (493 psig) and about 20.4 MPa (gauge) (2959 psig).

The separation vessel 44 may receive a stripping gas 50 which enters the separation vessel 44 below the inlet for the hydrotreated stream 34. The separation vessel 44 may include internals such as trays or packing to facilitate separation of the hydrotreated stream 34 into the hydrotreated vapor stream 46 and the hydrotreated liquid stream 48.

The hydrotreated vapor stream 46 may be mixed with an isomerized effluent stream 54, a cold aqueous stream 56 and cooled in a cooler 58, before being passed to a cold separator 60. In the cold separator 60, the components will separate into a hydrocarbon vapor stream 62, a hydrocarbon liquid stream 64, and the cold aqueous stream 56.

The hydrocarbon liquid stream 64 may pass to a heat exchanger 66 and then to a product recovery zone 68 where it can be separated and processed further with one or more stripper columns and fractionation columns to provide various product streams. As known the product recovery zone 68 may provide a liquid recycle stream 70. The details of the product recovery zone 68 are known. See, U.S. Pat. Nos. 8,198,492, 10,876,050, and 11,655,424.

The hydrocarbon vapor stream 62 may be split with a first portion 62*a* sent to a amine scrubber or a hydrogen recovery zone 72 which may include a PSA separator and processed further as is known in the art. A second portion 62*b* of the hydrocarbon vapor stream, which comprises the hydrotreated vapor stream 46, may be compressed and then utilized as the recycle gaseous stream 20, as well as the hydrogen quench streams 32.

In various embodiments of the present invention, the recycle gaseous stream 20, which is formed from the hydrocarbon vapor stream 62 and thus the hydrotreated vapor stream 46 is heated in an electric heater 74 before being mixed with the feed stream 12. This will allow the hydrotreated vapor stream 46 to heat the feed stream 12, and thus, allow the feed stream 12, to be heated by the electric heater 74. It should be appreciated and understood that this is not the only heating for the feed stream 12 and that this does not require that the feed stream 12 is only heated by being combined with the hydrocarbon vapor stream 62.

Returning to the separation vessel 44, the hydrotreated liquid stream 48 may be split into two portions, with a first portion 48*a* being recycled and combined with the feed stream 12 as the recycle liquid stream 22. A second portion 48*b* of the hydrotreated liquid stream 48 will form the isomerization feed stream 38. The second portion 48*b* of the hydrotreated liquid stream 48 may be combined with the recycle stream 70 from the product recovery zone 68, and a first portion 76*a* of a make-up hydrogen stream 76, which may be a combination of make-up hydrogen 79 and a vapor portion 80 of an isomerized effluent (discussed below).

The isomerization feed stream 38 may be heated in the heat exchanger 36 and combined a second portion 76*b* of the make-up hydrogen stream 76 which has been heated in an electric heater 74. The combination of the second portion 76*b* of the make-up hydrogen stream 76 thus further heats the isomerization feed stream 38. Again, other sources of heat may be used with the isomerization feed stream 38 before it is introduced into a reactor 78 in an isomerization reaction zone 81.

As is known, the reactor 78 in the isomerization reaction zone 81 contains a hydroisomerization catalyst, for example in one or more beds 82, and is operated under conditions to hydroisomerize the normal paraffins to branched paraffins. The hydroisomerization, including hydrodewaxing, of the normal hydrocarbons in the reactor 78 can be accomplished over one or more beds 82 of hydroisomerization catalyst, and the hydroisomerization may be operated in a co-current mode of operation. Fixed bed, trickle bed down-flow or fixed bed liquid filled up-flow modes are both suitable.

Suitable hydroisomerization catalysts may comprise a metal of Group VIII (IUPAC 8-10) of the Periodic Table and a support material. Suitable Group VIII metals include platinum and palladium, each of which may be used alone or in combination. The support material may be amorphous or crystalline. Suitable support materials include amorphous alumina, amorphous silica-alumina, ferrierite, ALPO-31, SAPO-11, SAPO-31, SAPO-37, SAPO-41, SM-3, MgAPSO-31, FU-9, NU-10, NU-23, ZSM-12, ZSM-22, ZSM-23, ZSM-35, ZSM-48, ZSM-50, ZSM-57, MeAPO-11, MeAPO-31, MeAPO-41, MgAPSO-11, MgAPSO-31, MgAPSO-41, MgAPSO-46, ELAPO-11, ELAPO-31, ELAPO-41, ELAPSO-11, ELAPSO-31, ELAPSO-41, laumontite, cancrinite, offretite, hydrogen form of stillbite, magnesium or calcium form of mordenite, and magnesium or calcium form of partheite, each of which may be used alone or in combination. ALPO-31 is described in U.S. Pat. No. 4,310,440. SAPO-11, SAPO-31, SAPO-37, and SAPO-41 are described in U.S. Pat. No. 4,440,871. SM-3 is described in U.S. Pat. Nos. 4,943,424; 5,087,347; 5,158,665; and 5,208,005. MgAPSO is a MeAPSO, which is an acronym for a metal aluminumsilicophosphate molecular sieve, where the metal, Me, is magnesium (Mg). Suitable MgAPSO-31 catalysts include MgAPSO-31. MeAPSOs are described in U.S. Pat. No. 4,793,984, and MgAPSOs are described in U.S. Pat. No. 4,758,419. MgAPSO-31 is a preferred MgAPSO, where 31 means a MgAPSO having structure type 31. Many natural zeolites, such as ferrierite, that have an initially reduced pore size can be converted to forms suitable for olefin skeletal isomerization by removing associated alkali metal or alkaline earth metal by ammonium ion exchange and calcination to produce the substantially hydrogen form, as taught in U.S. Pat. Nos. 4,795,623 and 4,924,027. Further catalysts and conditions for skeletal isomerization are disclosed in U.S. Pat. Nos. 5,510,306, 5,082,956, and 5,741,759. The hydroisomerization catalyst may also comprise a modifier selected from the group consisting of lanthanum, cerium, praseodymium, neodymium, samarium, gadolinium, terbium, and mixtures thereof, as described in U.S. Pat. Nos. 5,716,897 and 5,851,949. Other suitable support materials include ZSM-22, ZSM-23, and ZSM-35, which are described for use in dewaxing in U.S. Pat. No. 5,246,566 and in the article entitled S. J. Miller, "New Molecular Sieve Process for Lube Dewaxing by Wax Isomerization," 2 Microporous Materials 439-449 (1994). U.S. Pat. Nos. 5,444,032 and 5,608,968 teach a suitable bifunctional catalyst which is constituted by an amorphous silica-alumina gel and one or more metals belonging to Group VIIIA, and is effective in the hydroisomerization of long-chain normal paraffins containing more than 15 carbon atoms. U.S. Pat. Nos. 5,981,419 and 5,908,134 teach a suitable bifunctional catalyst which comprises: (a) a porous crystalline material isostructural with beta-zeolite selected from boro-silicate (BOR-B) and boro-alumino-silicate (Al—BOR—B) in which the molar SiO2: Al2O3 ratio is higher than 300:1; (b) one or more metal(s) belonging to Group VIIIA, selected from platinum and palladium, in an amount comprised within the range of from 0.05 to 5% by weight. V. Calemma et al., App. Catal. A: Gen., 190 (2000), 207 teaches yet another suitable catalyst. DI-100 or DI-200 available from UOP LLC in Des Plaines, Ill. may be a suitable catalyst.

Hydroisomerization conditions generally include a temperature of about 150° C. (302° F.) to about 450° C. (842° F.) and a pressure of about 1724 kPa (abs) (250 psia) to about 13.8 MPa (abs) (2000 psia). In another embodiment, the hydroisomerization conditions include a temperature of about 300° C. (572° F.) to about 360° C. (680° F.) and a pressure of about 3102 kPa (abs) (450 psia) to about 6895 kPa (abs) (1000 psia).

An isomerized stream 84 from the reactor 78 is a branched-paraffin-rich stream. By the term "rich" it is meant that the isomerized stream 84 has a greater concentration of branched paraffins than the stream 38 entering the reactor 78, and preferably comprises greater than 50 mass-% branched paraffins of the total paraffin content. It is envisioned that the isomerized effluent may contain 70, 80, or 90 mass-% branched paraffins of the total paraffin content. Only minimal branching is required, enough to improve the cold-flow properties of the hydrotreated hot liquid stream to meet specifications. Hydroisomerization conditions are selected to avoid undesirable cracking, so the predominant product in the isomerized stream is a mono-branched paraffin.

The isomerized stream 84 from the reactor 78 may pass to the heat exchanger 66 (discussed above) to cool it before entering a separator 86 for separation into a liquid isomerized stream 88 and a vapor isomerized stream 90. The liquid isomerized stream 88 may be combined with the hydrotreated vapor stream 46 as the isomerized effluent stream 54 and processed as discussed above.

The vapor isomerized stream 90 may be passed to a receiver vessel 94. A first portion 96*a* of an overhead stream 96 may be compressed in a compressor 98 and then utilized as the stripping gas 50 in the separation vessel 44 as discussed above. The vapor portion 80 of the isomerized effluent which is combined with the make-up hydrogen stream 76 (discussed above) is formed from a second portion of the overhead stream 96. This stream comprises the vapor isomerized stream 90.

Accordingly, in the foregoing, portions of the gaseous streams formed from the effluents from the reaction zones 28, 81 are heated with electric heaters 74 so that the feed streams 12, 38 for the reaction zones 28, 81 can be heated by being combined with the heated vapor streams 20, 76*b*. This allows the feed streams 12, 38 to be heated, in part, by electric heaters 74.

While the foregoing description described both reaction zones 28, 81 using electric heaters 74, it is also contemplated that one of the reaction zones 28, 81 may still utilize a fired heater 100. For example, the feed stream 12 for the hydrotreating reaction zone 28 may be heated in a fired heater 100, while the isomerization reaction zone 81 utilizes an electric heater 74. Alternatively, the hydrotreating reaction zone 28 may utilize an electric heater 74, while the isomerization reaction zone 81 utilizes a fired heater 100. Even with only one of the reaction zones 28, 81 using an electric heater 74, the present invention still provides for the effective and efficient use of an electric heater 74.

Experiments

In a theoretical example, in which both fired heaters were replaced with electric heaters, a reduction of 23% carbon dioxide emissions. Additionally, the utilization of the electric heaters reduced operating and capital expenses as well.

Specific Embodiments

While the following is described in conjunction with specific embodiments, it will be understood that this description is intended to illustrate and not limit the scope of the preceding description and the appended claims.

A first embodiment of the invention is a process for hydrotreating a feedstock, the process comprising heating a feed stream comprising a biorenewable feedstock to provide a heated feed stream; hydrotreating the heated feed stream in a first reaction zone comprising a first reactor vessel having a hydrotreating catalyst and providing a hydrotreated stream; separating the hydrotreated stream into a hydrotreated liquid stream and a hydrotreated gas stream; heating an isomerization feed stream, wherein the isomerization feed stream comprises at least a portion of the hydrotreated liquid stream; isomerizing the isomerization feed stream in a second reaction zone comprising a second reactor vessel having an isomerization catalyst and providing an isomerized stream; and, separating the isomerized stream into an isomerized liquid stream and an isomerized gas stream; wherein either both the hydrotreated gas stream and the isomerized gas stream have been separately heated in electric heaters to provide, respectively, a heated hydrotreated gas stream and a heated isomerized gas stream and the feed stream is heated by being combined with the heated hydrotreated gas stream and the isomerization feed stream is heated by being combined with the heated isomerized gas stream; or, only one of the hydrotreated gas stream and the isomerized gas stream has been heated in an electric heater to provide a heated gas stream which heats, by being combined with, one of the feed stream or the isomerization feed stream, and the other of the feed stream or the isomerization feed stream is heated in a fired heater. An embodiment of the invention is one, any or all of prior embodiments in this paragraph up through the first embodiment in this paragraph, wherein both the hydrotreated gas stream and the isomerized gas stream have been separately heated in electric heaters to provide, respectively, the heated hydrotreated gas stream and the heated isomerized gas stream and the feed stream is heated by being combined with the heated hydrotreated gas stream and the isomerization feed stream is heated by being combined with the heated isomerized gas stream. An embodiment of the invention is one, any or all of prior embodiments in this paragraph up through the first embodiment in this paragraph, wherein only one of the hydrotreated gas stream and the isomerized gas stream has been heated in an electric heater which heats, by being combined with, one of the feed stream or the isomerization feed stream, and the other of the feed stream or the isomerization feed stream is heated in the fired heater. An embodiment of the invention is one, any or all of prior embodiments in this paragraph up through the first embodiment in this paragraph, wherein the hydrotreated gas stream has been heated in the electric heater to provide the heated hydrotreated gas stream and the feed stream is heated by being combined with the heated hydrotreated gas stream. An embodiment of the invention is one, any or all of prior embodiments in this paragraph up through the first embodiment in this paragraph, wherein the isomerization feed stream has been heated in the fired heater. An embodiment of the invention is one, any or all of prior embodiments in this paragraph up through the first embodiment in this paragraph, wherein the isomerized gas stream has been heated in the electric heater to provide the heated isomerized gas stream and the isomerization feed stream is heated by being combined with the heated isomerized gas stream. An embodiment of the invention is one, any or all of prior embodiments in this paragraph up through the first embodiment in this paragraph, wherein the feed stream has been heated in the fired heater. An embodiment of the invention is one, any or all of prior embodiments in this paragraph up through the first embodiment in this paragraph, further comprising compressing the hydrotreated gas stream. An embodiment of the invention is one, any or all of prior embodiments in this paragraph up through the first embodiment in this paragraph, further comprising compressing the isomerized gas stream.

A second embodiment of the invention is a process for hydrotreating a feedstock, the process comprising heating a feed stream comprising a biorenewable feedstock to provide a heated feed stream; passing the heated feed stream to a first reaction zone comprising a first reactor vessel having a hydrotreating catalyst and being operated under conditions to hydrotreat the heated feed stream and provide a hydrotreated stream; passing the hydrotreated stream to a first separation zone configured to separate the hydrotreated stream into a hydrotreated liquid stream and a hydrotreated gas stream; heating an isomerization feed stream to provide a heated isomerization feed stream, wherein the isomerization feed stream comprises at least a portion of the hydrotreated liquid stream; passing the heated isomerization feed stream to a second reaction zone comprising a second reactor vessel having an isomerization catalyst and being operated under conditions to isomerize the heated portion of the hydrotreated liquid stream and provide an isomerized stream; and, passing the separating the isomerized stream into an isomerized liquid stream and an isomerized gas stream; wherein the process further comprises passing the hydrotreated gas stream to a first electric heater to provide a heated hydrotreated gas stream, wherein the feed stream is heated by being combined with the heated hydrotreated gas stream, and passing the isomerized gas stream to a second electric heater to provide a heated isomerized gas stream, wherein the isomerization feed stream is heated by being combined with the heated isomerized gas stream; or, passing the hydrotreated gas stream to a first electric heater to provide a heated hydrotreated gas stream, wherein the feed stream is heated by being combined with the heated hydrotreated gas stream, and wherein the isomerization feed stream is heated in a fired heater to provide the heated isomerization feed stream; or, passing the isomerized gas stream to a second electric heater to provide a heated isomerized gas stream, wherein the isomerization feed stream is heated by being combined with the heated isomerized gas stream, and wherein the feed stream is heated in a fired heater to provide the heated feed stream. An embodiment of the invention is one, any or all of prior embodiments in this paragraph up through the second embodiment in this paragraph, wherein the process further comprises passing the hydrotreated gas stream to the first electric heater to provide the heated hydrotreated gas stream, wherein the feed stream is heated by being combined with the heated hydrotreated gas stream, and passing the isomerized gas stream to the second electric heater to provide the heated isomerized gas stream, wherein the isomerization feed stream is heated by being combined with the heated isomerized gas stream. An embodiment of the invention is one, any or all of prior embodiments in this paragraph up through the second embodiment in this paragraph, further comprising compressing the hydrotreated gas stream before passing the hydrotreated gas stream to the first electric heater. An embodiment of the invention is one, any or all of prior embodiments in this paragraph up through the second embodiment in this paragraph, further comprising compressing the isomerized gas stream before passing the isomerized gas stream to the second electric heater. An embodiment of the invention is one, any or all of prior embodiments in this paragraph up through the second embodiment in this paragraph, wherein the process further comprises passing the hydrotreated gas stream to a first electric heater to provide a heated hydrotreated gas stream, wherein the feed stream is heated by being combined with the heated hydrotreated gas stream, and wherein the isomerization feed stream is heated in a fired heater to provide the heated portion of the hydrotreated liquid stream. An embodiment of the invention is one, any or all of prior embodiments in this paragraph up through the second embodiment in this paragraph, further comprising compressing the hydrotreated gas stream before passing the hydrotreated gas stream to the first electric heater. An embodiment of the invention is one, any or all of prior embodiments in this paragraph up through the second embodiment in this paragraph, wherein the process further comprises passing the isomerized gas stream to a second electric heater to provide a heated isomerized gas stream, wherein the isomerization feed stream is heated by being combined with the heated isomerized gas stream, and wherein the feed stream is heated in a fired heater to provide the heated feed stream. An embodiment of the invention is one, any or all of prior embodiments in this paragraph up through the second embodiment in this paragraph, further comprising compressing the isomerized gas stream before passing the isomerized gas stream to the second electric heater.

A third embodiment of the invention is a process for hydrotreating a feedstock, the process comprising hydrotreating a feed stream comprising a biorenewable feedstock in a first reaction zone comprising a first reactor vessel having a hydrotreating catalyst and providing a hydrotreated stream; separating the hydrotreated stream into a hydrotreated liquid stream and a hydrotreated gas stream; heating the hydrotreated gas stream in a first heating zone to provide a heated hydrotreated gas stream; combining the heated hydrotreated gas stream and the feed stream; isomerizing an isomerization feed stream in a second reaction zone comprising a second reactor vessel having an isomerization catalyst and providing an isomerized stream, the isomerization feed stream comprising at least a portion of the hydrotreated liquid stream; separating the isomerized stream into an isomerized liquid stream and an isomerized gas stream; heating the isomerized gas stream in a second heating zone to provide a heated isomerized gas stream; and, combining the heated isomerized gas stream and the hydrotreated liquid stream, wherein both the first and the second heating zones comprise an electric heater. An embodiment of the invention is one, any or all of prior embodiments in this paragraph up through the third embodiment in this paragraph, further comprising compressing the hydrotreated gas stream in a first compression zone comprising a compressor before heating the hydrotreated gas stream in the first heating zone. An embodiment of the invention is one, any or all of prior embodiments in this paragraph up through the third embodiment in this paragraph, further comprising compressing the isomerized gas stream in a second compression zone comprising a compressor before heating the isomerized gas stream in the second heating zone.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for hydrotreating a feedstock, the process comprising:

heating a feed stream comprising a biorenewable feedstock to provide a heated feed stream;

hydrotreating the heated feed stream in a first reaction zone comprising a first reactor vessel having a hydrotreating catalyst and providing a hydrotreated stream;

separating the hydrotreated stream into a hydrotreated liquid stream and a hydrotreated gas stream;

heating an isomerization feed stream, wherein the isomerization feed stream comprises at least a portion of the hydrotreated liquid stream;

isomerizing the isomerization feed stream in a second reaction zone comprising a second reactor vessel having an isomerization catalyst and providing an isomerized stream; and, separating the isomerized stream into an isomerized liquid stream and an isomerized gas stream;

wherein either:

both the hydrotreated gas stream and the isomerized gas stream have been separately heated in electric heaters to provide, respectively, a heated hydrotreated gas stream and a heated isomerized gas stream and the feed stream is heated by being combined with the heated hydrotreated gas stream and the isomerization feed stream is heated by being combined with the heated isomerized gas stream; or, only one of the hydrotreated gas stream and the isomerized gas stream has been heated in an electric heater to provide a heated gas stream which heats, by being combined with, one of the feed stream or the isomerization feed stream, and the other of the feed stream or the isomerization feed stream is heated in a fired heater.

2. The process of claim 1, wherein both the hydrotreated gas stream and the isomerized gas stream have been separately heated in electric heaters to provide, respectively, the heated hydrotreated gas stream and the heated isomerized gas stream and the feed stream is heated by being combined with the heated hydrotreated gas stream and the isomerization feed stream is heated by being combined with the heated isomerized gas stream.

3. The process of claim 1, wherein only one of the hydrotreated gas stream and the isomerized gas stream has been heated in an electric heater which heats, by being combined with, one of the feed stream or the isomerization feed stream, and the other of the feed stream or the isomerization feed stream is heated in the fired heater.

4. The process of claim 1, wherein the hydrotreated gas stream has been heated in the electric heater to provide the heated hydrotreated gas stream and the feed stream is heated by being combined with the heated hydrotreated gas stream.

5. The process of claim 4, wherein the isomerization feed stream has been heated in the fired heater.

6. The process of claim 1, wherein the isomerized gas stream has been heated in the electric heater to provide the heated isomerized gas stream and the isomerization feed stream is heated by being combined with the heated isomerized gas stream.

7. The process of claim 6, wherein the feed stream has been heated in the fired heater.

8. The process of claim 1, further comprising:

compressing the hydrotreated gas stream.

9. The process of claim 1, further comprising:

compressing the isomerized gas stream.

10. A process for hydrotreating a feedstock, the process comprising:

heating a feed stream comprising a biorenewable feedstock to provide a heated feed stream;

passing the heated feed stream to a first reaction zone comprising a first reactor vessel having a hydrotreating catalyst and being operated under conditions to hydrotreat the heated feed stream and provide a hydrotreated stream;

passing the hydrotreated stream to a first separation zone configured to separate the hydrotreated stream into a hydrotreated liquid stream and a hydrotreated gas stream;

heating an isomerization feed stream to provide a heated isomerization feed stream, wherein the isomerization feed stream comprises at least a portion of the hydrotreated liquid stream;

passing the heated isomerization feed stream to a second reaction zone comprising a second reactor vessel having an isomerization catalyst and being operated under conditions to isomerize the heated portion of the hydrotreated liquid stream and provide an isomerized stream; and, passing the isomerized stream to a second separation zone configured to separate the isomerized stream into an isomerized liquid stream and an isomerized gas stream;

wherein the process further comprises:

passing the hydrotreated gas stream to a first electric heater to provide a heated hydrotreated gas stream, wherein the feed stream is heated by being combined with the heated hydrotreated gas stream, and passing the isomerized gas stream to a second electric heater to provide a heated isomerized gas stream, wherein the isomerization feed stream is heated by being combined with the heated isomerized gas stream; or, passing the hydrotreated gas stream to a first electric heater to provide a heated hydrotreated gas stream, wherein the feed stream is heated by being combined with the heated hydrotreated gas stream, and wherein the isomerization feed stream is heated in a fired heater to provide the heated isomerization feed stream; or, passing the isomerized gas stream to a second electric heater to provide a heated isomerized gas stream, wherein the isomerization feed stream is heated by being combined with the heated isomerized gas stream, and wherein the feed stream is heated in a fired heater to provide the heated feed stream.

11. The process of claim 10, wherein the process further comprises:

passing the hydrotreated gas stream to the first electric heater to provide the heated hydrotreated gas stream, wherein the feed stream is heated by being combined with the heated hydrotreated gas stream, and passing the isomerized gas stream to the second electric heater to provide the heated isomerized gas stream, wherein the isomerization feed stream is heated by being combined with the heated isomerized gas stream.

12. The process of claim 11, further comprising:

compressing the hydrotreated gas stream before passing the hydrotreated gas stream to the first electric heater.

13. The process of claim 12, further comprising:

compressing the isomerized gas stream before passing the isomerized gas stream to the second electric heater.

14. The process of claim 10, wherein the process further comprises:

passing the hydrotreated gas stream to a first electric heater to provide a heated hydrotreated gas stream, wherein the feed stream is heated by being combined with the heated hydrotreated gas stream, and wherein the isomerization feed stream is heated in a fired heater to provide the heated portion of the hydrotreated liquid stream.

15. The process of claim 14, further comprising:

compressing the hydrotreated gas stream before passing the hydrotreated gas stream to the first electric heater.

16. The process of claim 10, wherein the process further comprises:

passing the isomerized gas stream to a second electric heater to provide a heated isomerized gas stream, wherein the isomerization feed stream is heated by being combined with the heated isomerized gas stream, and wherein the feed stream is heated in a fired heater to provide the heated feed stream.

17. The process of claim 16, further comprising:

compressing the isomerized gas stream before passing the isomerized gas stream to the second electric heater.

18. A process for hydrotreating a feedstock, the process comprising:

hydrotreating a feed stream comprising a biorenewable feedstock in a first reaction zone comprising a first reactor vessel having a hydrotreating catalyst and providing a hydrotreated stream;

separating the hydrotreated stream into a hydrotreated liquid stream and a hydrotreated gas stream;

heating the hydrotreated gas stream in a first heating zone to provide a heated hydrotreated gas stream;

combining the heated hydrotreated gas stream and the feed stream;

isomerizing an isomerization feed stream in a second reaction zone comprising a second reactor vessel having an isomerization catalyst and providing an isomerized stream, the isomerization feed stream comprising at least a portion of the hydrotreated liquid stream;

separating the isomerized stream into an isomerized liquid stream and an isomerized gas stream;

heating the isomerized gas stream in a second heating zone to provide a heated isomerized gas stream; and, combining the heated isomerized gas stream and the hydrotreated liquid stream, wherein both the first and the second heating zones comprise an electric heater.

19. The process of claim 18, further comprising:

compressing the hydrotreated gas stream in a first compression zone comprising a compressor before heating the hydrotreated gas stream in the first heating zone.

20. The process of claim 19, further comprising:

compressing the isomerized gas stream in a second compression zone comprising a compressor before heating the isomerized gas stream in the second heating zone.

* * * * *